US005167564A

United States Patent [19]

Lord

[11] Patent Number: 5,167,564

[45] Date of Patent: Dec. 1, 1992

[54] TOY CLOTHES RACK APPARATUS

[76] Inventor: Murray L. Lord, RFD #1, Box 645, Bristol, N.H. 03222

[21] Appl. No.: 808,472

[22] Filed: Dec. 16, 1991

[51] Int. Cl.[5] ..... A63H 3/52; A63H 33/26; A41D 27/22; A47F 7/06

[52] U.S. Cl. ..... 446/479; 446/476; 446/474; 446/129; 211/34; 211/206; 211/123; 223/86; 223/98

[58] Field of Search ..... 446/479, 482, 489, 476, 446/478, 474, 472, 129; 211/37, 36, 34, 105, 105.1, 123, 206; 223/86, 87, 98

[56] References Cited

U.S. PATENT DOCUMENTS

| | | | |
|---|---|---|---|
| D. 121,783 | 8/1940 | Castelli et al. | 211/37 X |
| 1,209,314 | 12/1916 | MacCoroy | 446/479 |
| 2,135,277 | 11/1938 | Coney | 223/98 |
| 2,158,539 | 5/1939 | Grotte et al. | 223/86 |
| 2,420,101 | 5/1947 | Samann | 223/98 X |
| 2,894,644 | 7/1959 | Magnuson et al. | 211/206 |
| 2,947,422 | 8/1960 | Sudberry | 211/206 X |
| 3,144,946 | 8/1964 | Ellis | 211/206 X |
| 3,303,938 | 2/1967 | Solomon | 211/206 X |
| 3,733,016 | 5/1973 | Rood | 233/86 |
| 3,888,353 | 6/1975 | Leifheit | 211/37 |

FOREIGN PATENT DOCUMENTS

| | | | |
|---|---|---|---|
| 893947 | 4/1962 | United Kingdom | 223/86 |

*Primary Examiner*—D. Neal Muir
*Attorney, Agent, or Firm*—Leon Gilden

[57] ABSTRACT

A clothes rack for use with doll clothing and the like is arranged, wherein spaced side walls mount a hanger supporting rod orthogonally therebetween underlying a roof plate for use in storage of various components of doll accessories. A trio of connecting rods at lower distal ends of the side walls define a shoe-receiving slot for reception of shoes therewithin. The hanger structure of the invention is arranged to optionally include a mounting frame to accommodate elongated doll clothing of various sizes and is formed with magnet members to effect a spacing of the hangers when arranged in adjacency relative to one another by magnets of confronting like polarity. The mounting frames are further provided with fluid reservoirs to direct various scented fluids about an overlying wick structure of the mounting hanger organization.

5 Claims, 4 Drawing Sheets

TOY CLOTHES RACK APPARATUS

BACKGROUND OF THE INVENTION

1. Field of the Invention

The field of invention relates to doll and accessory components therefore, and more particularly pertains to a new and improved toy clothes rack apparatus wherein the same is arranged for the securement and storage of doll clothing.

2. Description of the Prior Art

Doll accessories of various types are utilized in the prior art to accommodate the hobby of the use of dolls, wherein various components in this regard are provided and are exemplified in U.S. Pat. No. 4,285,155 to Lewis setting forth a toy shaving set for dolls.

U.S. Pat. No. 4,571,207 to Henderson, et al. sets forth an exercise toy for dolls.

U.S. Pat. No. 4,297,153 to Erickson, et al. sets forth doll clothing and the like.

As such, it may be appreciated that there continues to be a need for a new and improved toy clothes rack apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of toy apparatus now present in the prior art, the present invention provides a toy clothes rack apparatus wherein the same is arranged for the support and securement of doll clothing thereon. As such, the general purpose of the present invention, which will be described subsequently in greater detail, is to provide a new and improved toy clothes rack apparatus which has all the advantages of the prior art toy apparatus and none of the disadvantages.

To attain this, the present invention provides a clothes rack for use with doll clothing and the like, wherein spaced side walls mount a hanger supporting rod orthogonally therebetween underlying a roof plate for use in storage of various components of doll accesories. A trio of connecting rods at lower distal ends of the side walls define a shoe-receiving slot for reception of shoes therewithin. The hanger structure of the invention is arranged to optionally include a mounting frame to accommodate elongated doll clothing of various sizes and is formed with magnet members to effect spacing of the hangers when arranged in adjacency relative to one another by magnets of confronting like polarity. The mounting frames are further porvided with fluid reservoirs to direct various scented fluids about an overlying wick structure of the mounting hanger organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purposes of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy clothes rack apparatus which has all the advantages of the prior art toy apparatus and none of the disadvantages.

It is another object of the present invention to provide a new and improved toy clothes rack apparatus which may be easily and efficiently manufactured and marketed.

It is a further object of the present invention to provide a new and improved toy clothes rack apparatus which is of a durable and reliable construction.

An even further object of the present invention is to provide a new and improved toy clothes rack apparatus which is susceptible of a low cost of manufacture with regard to both materials and labor, and which accordingly is then susceptible of low prices of sale to the consuming public, thereby making such toy clothes rack apparatus economically available to the buying public.

Still yet another object of the present invention is to provide a new and improved toy clothes rack apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
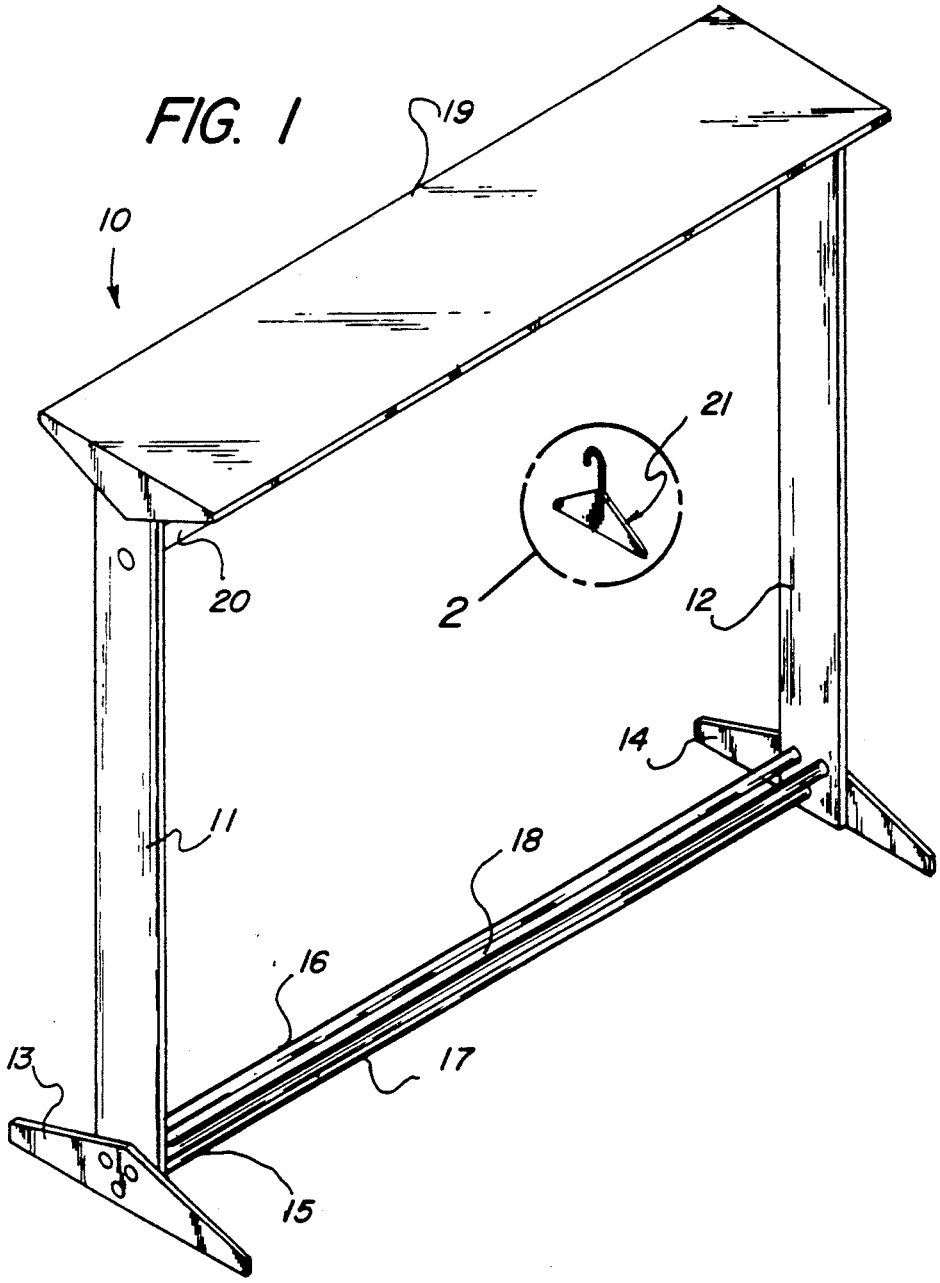
FIG. 1 is an isometric illustration of the instant invention.
Figure 2:
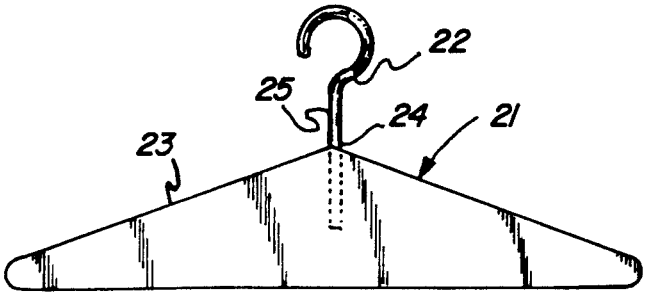
FIG. 2 is an orthographic view of the clothes hanger, as set forth in section 2 of FIG. 1.
Figure 3:
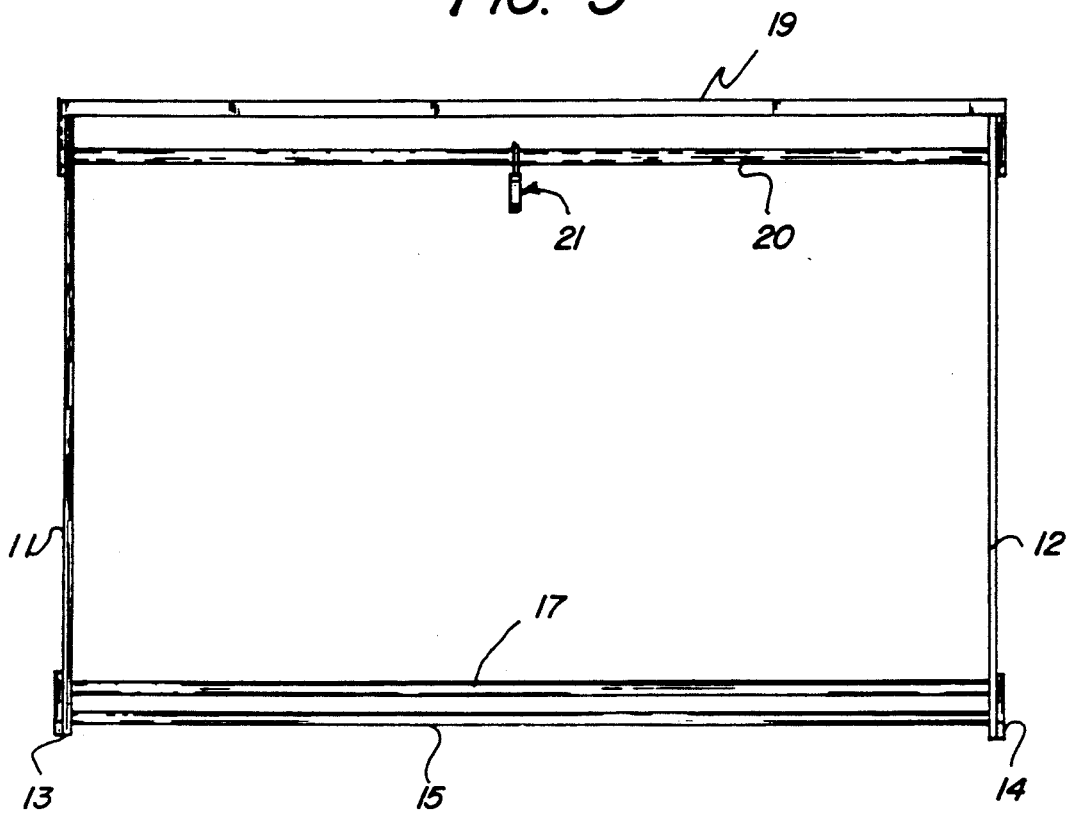
FIG. 3 is an orthographic side view of the clothes rack structure.
Figure 4:
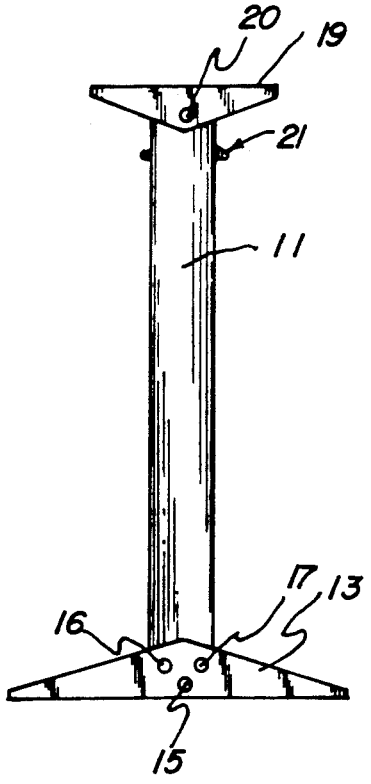
FIG. 4 is an orthographic end view of the clothes rack structure.

With reference now to the drawings, and in particular to FIGS. 1 to 10 thereof, a new and improved toy clothes rack apparatus embodying the principles and concepts of the present invention and generally designated by the reference numeral 10 will be described.

More specifically, the clothes rack apparatus 10 of the instant invention essentially comprises a first side wall 11 that is arranged in a parallel coextensive relationship relative to a second side wall 12. The first side wall 11 includes a first foot plate 13 at its lower distal end orthogonally extending laterally of the first side wall, with a second foot plate 14 mounted at a lower distal end of the second side wall 12 extending laterally relative to the lower distal end of the second side wall, with the first and second foot plates 13 and 14 arranged in a parallel relationship. A first connecting rod 15 is orthogonally oriented through the first and second side walls and the first and second foot plates and positioned below and parallel to second and third connecting rods 16 and 17 that are arranged in adjacency relative to one another to define a shoe-receiving slot 18 therebetween to accommodate the heels and the like of doll shoes within the slot 18. A roof plate 19 is orthogonally mounted to the upper distal ends of the first and second side walls 11 and 12, with an underlying hanger rod 20 extending below the roof plates 19 and orthogonally between the first and second side walls 11 and 12. A plurality of hangers 21 are arranged for mounting to the hanger rod 20, where for purposes of illustration one such exemplary hanger 21 is illustrated that includes a support hook 22 mounted to the support hook shank 25 extending downwardly for securement to a support frame 23.

Figure 5:
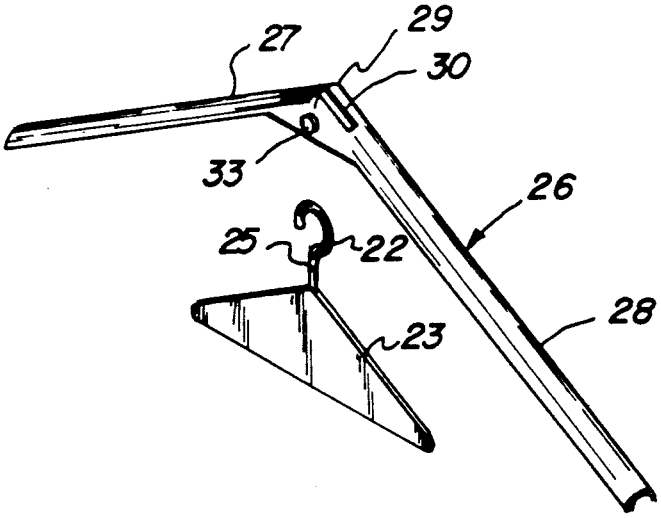
FIG. 5 is an isometric illustration of a mounting frame for use with each hanger member of the invention.
Figure 6:
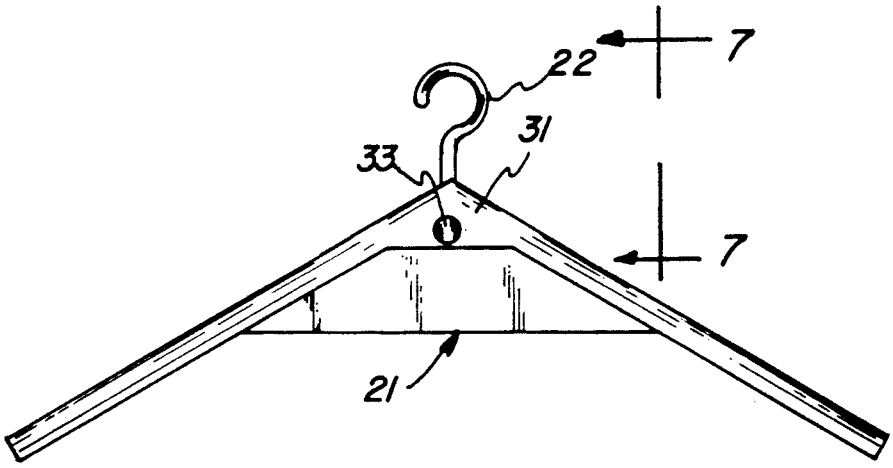
FIG. 6 is an orthographic side view of the mounting frame in association with the hanger member.
Figure 7:
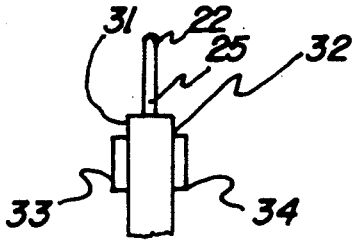
FIG. 7 is an orthographic end view of the hanger structure.
Figure 8:
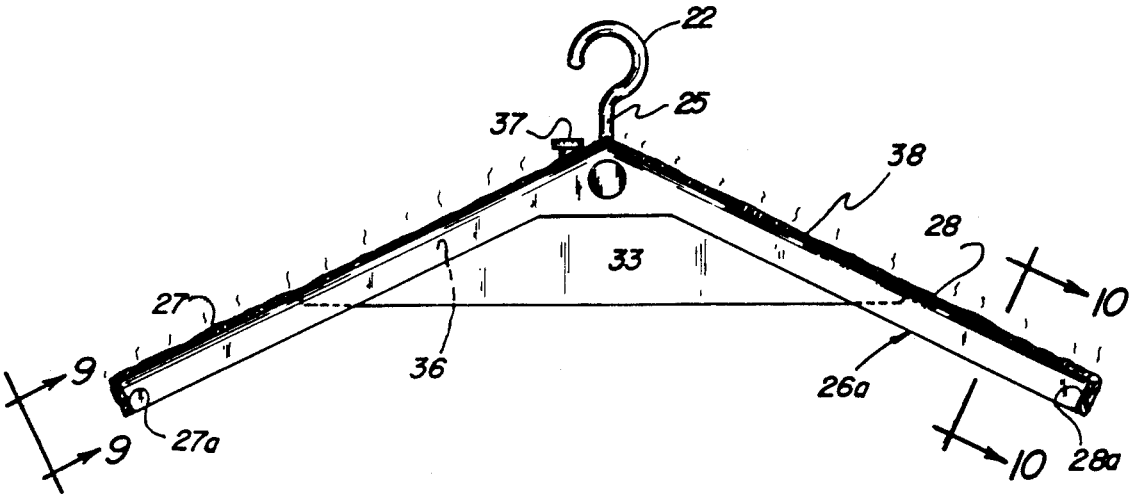
FIG. 8 is an orthographic side view of a modification of the mounting frame structure.
Figure 9:
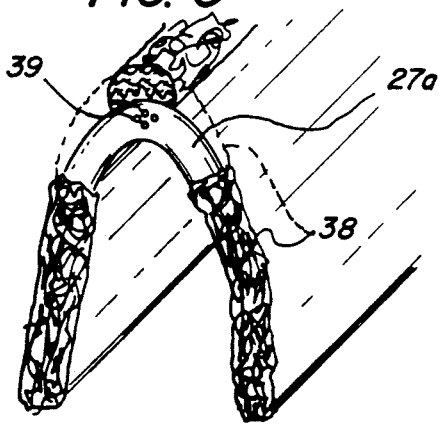
FIG. 9 is an orthographic view, taken along the lines 9—9 of FIG. 8 in the direction indicated by the arrows.
Figure 10:
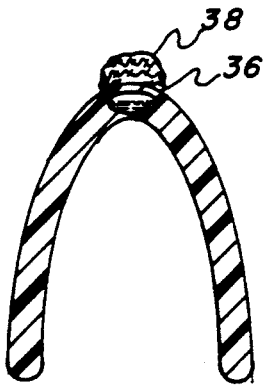
FIG. 10 is an orthographic view, taken along the lines 10—10 of FIG. 8 in the direction indicated by the arrows.

The support frame 23 (as illustrated in FIG. 5) is arranged for reception within a mounting frame 26. The mounting frame 26 includes a mounting frame first leg 27 and a mounting frame second leg 28 joined together at an obtuse included angle at a leg intersection, with a leg intersection slot 30 directed longitudinally of the mounting frame 26 extending into the first and second legs 27 and 28 from the leg intersection 29. The leg intersection slot 30 receives the support hook 22 and the associated shank 25 therethrough, with the support frame 23 received within the first and second legs 27 and 28. The first and second legs 27 and 28 are of a generally arcuate configuration defining a convex cavity therebelow (see FIG. 5 and FIG. 10) to receive the support frame 23 fixedly within the concave cavity of each of the first and second legs 27 and 28.

The mounting frame 26 includes first leg intersection first and second side walls 31 and 32 respectively mounting a respective first and second magnet 33 and 34. The magnets 33 and 34 include a respective first and second exposed face 33*a* and 34*a* respectively, each of a first polarity. In this manner, when adjacent hangers are positioned upon the support rod 20, the like polarity of adjacent magnets effect a mandatory spacing between adjacent hangers to provide for convenient spacing of the hangers as they are positioned along the support hanger rod 20.

A modified mounting frame 26*a* includes a reservoir cavity 36 that is coextensively directed within the mounting frame first and second legs 27 and 28 accessed to through a fill conduit 37 to permit the filling of a scented fluid within the reservoir cavity 36 (see FIG. 10), wherein the fluid is directed from the reservoir cavity 36 through end wall bores 39 formed within the respective mounting frame first and second leg end walls 27*a* and 28*a* respectively. The fluid thusly directed through the end wall bores 39 is received within a fibrous wick 38 that is formed coextensively along the end walls 27*a* and 28*a* and along the wick that is formed at the top surface of the arcuate and generally "C" shaped legs 27 and 28. In this manner, the scented perfume may be directed into associated doll clothing mounted upon the hanger structure, as illustrated in the FIG. 8.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toy clothes rack apparatus, comprising, a first side wall arranged parallel to and coextensive with a second side wall, the first side wall including a first foot plate mounted at a lower distal end of the first side wall extending laterally of the first side wall, and the second side wall including a second foot plate mounted to a lower distal end of the second side wall extending laterally of the second side wall and the first foot plate and the second foot plate are arranged in a parallel relationship, and a first connecting rod extending orthogonally between the first side wall and the second side wall and through the first foot plate and the second foot plate, and a second connecting rod and a third connecting rod arranged parallel relative to one another and spaced above and parallel to the first connecting rod, wherein the second connecting rod and the third connecting rod define a shoe receiving slot between the second connecting rod and the third connecting rod coextensively directed between the first side wall and the second side wall, and a roof plate mounted to an upper distal end of the first side wall and to an upper distal end of the second side wall extending orthogonally between the first side wall and the second side wall, and a hanger rod mounted orthogonally between the first side wall and the second side wall and adjacent the roof plate in a spaced relationship relative to the roof plate, and at least one hanger member arranged for selective securement to the hanger rod, the at least one hanger member including a support hook, the support hook formed to an upper distal end of a support hook shank, the support hook shank extending downwardly, and a mounting frame, the mounting frame fixedly mounted to a lower distal end of the support hook shank.

2. An apparatus as set forth in claim 1, the mounting frame including a mounting frame first leg and a mounting frame second leg defining an obtuse angle therebetween, the mounting frame first leg and the mounting frame second leg joined together at a leg intersection, the leg intersection defining a leg intersection first side wall spaced from and parallel a leg intersection second side wall, and a leg intersection slot directed through the leg intersection extending along the first leg and the second leg longitudinally of the first leg and the second leg, and the leg intersection slot receiving the support hook shank therethrough.

3. An apparatus as set forth in claim 2 wherein the mounting frame first leg and the mounting frame second leg are each of a generally "C" shaped configuration defining a mounting frame first leg concave cavity and a mounting frame second leg concave cavity to receive the support frame therewithin, wherein the mounting frame first leg and the mounting frame second leg extend longitudinally beyond the support frame of the hanger member.

4. An apparatus as set forth in claim 3 wherein the leg intersection first side wall includes a first magnet member and the leg intersection second side wall includes a second magnet member, the first magnet member includes an exposed first face, and the second magnet member includes a second magnet member exposed first face, and wherein each first face is defined by a like magnetic polarity to effect magnetic repulsion of adjacent mounting frames.

5. An apparatus as set forth in claim 4 wherein the mounting frame first leg and the mounting frame second leg are hollow and define a reservoir cavity therewithin, and a fill conduit directed into the reservoir cavity to effect filling of the reservoir cavity and the fluid contained within the reservoir cavity, and the mounting frame first leg including a mounting frame first leg end wall and the mounting frame second leg including a mounting frame second leg end wall, wherein the mounting frame first leg end wall and the mounting frame second leg end wall each include a matrix of end wall bores directed therethrough in fluid communication with the reservoir cavity, and a fibrous wick mounted to a top surface of the mounting frame first leg and the mounting frame second leg and the fibrous wick extends along the mounting frame first leg end wall and along the mounting frame second leg end wall to direct the fluid into the fibrous wick, wherein the fibrous wick is of a continuous construction from the mounting frame first leg end wall to the mounting frame second leg end wall.

* * * * *